US007377048B2

(12) United States Patent
Koetter

(10) Patent No.: US 7,377,048 B2
(45) Date of Patent: May 27, 2008

(54) TRUSS SETTING BRACKET

(76) Inventor: Raymond E. Koetter, 5102 Saint John Rd., Floyds Knobs, IN (US) 47119

( * ) Notice: Subject to any disclaimer, the term of this patent is extended or adjusted under 35 U.S.C. 154(b) by 148 days.

(21) Appl. No.: 11/387,789

(22) Filed: Mar. 24, 2006

(65) Prior Publication Data

US 2007/0044418 A1 Mar. 1, 2007

Related U.S. Application Data

(63) Continuation-in-part of application No. 11/209,852, filed on Aug. 24, 2005.

(51) Int. Cl.

| | |
|---|---|
| ***G01D 21/00*** | (2006.01) |
| ***E04G 21/04*** | (2006.01) |
| ***B23Q 3/02*** | (2006.01) |
| ***B25B 1/20*** | (2006.01) |

(52) U.S. Cl. ..... 33/613; 52/127.2; 269/95; 269/37

(58) Field of Classification Search ..... 52/643, 52/739.1, 127.2, 745.06; 33/613, 645; 269/37, 269/6, 95, 43, 3

See application file for complete search history.

(56) References Cited

U.S. PATENT DOCUMENTS

| | | | | |
|---|---|---|---|---|
| 2,567,586 | A | 9/1951 | Werder | |
| 2,686,959 | A | 8/1954 | Robinson | |
| 2,964,807 | A * | 12/1960 | Kennedy | 52/696 |
| 3,201,874 | A | 8/1965 | Christy | |
| 3,959,945 | A | 6/1976 | Allen | |
| 4,322,064 | A | 3/1982 | Jarvis | |
| 4,420,921 | A | 12/1983 | Hardin | |
| 4,704,829 | A | 11/1987 | Baumker, Jr. | |
| 4,893,801 | A * | 1/1990 | Flinn | 269/6 |
| 4,958,814 | A | 9/1990 | Johnson | |
| 5,490,334 | A | 2/1996 | Payne | |
| 5,628,119 | A | 5/1997 | Bingham et al. | |
| 5,884,411 | A | 3/1999 | Raber | |
| 6,212,749 | B1 * | 4/2001 | Chow et al. | 29/281.5 |
| 6,385,859 | B1 | 5/2002 | Varney | |
| 6,393,794 | B1 | 5/2002 | Pellock | |
| 7,040,610 | B2 * | 5/2006 | Hubbard | 269/267 |
| 2002/0092259 | A1 | 7/2002 | Crawford et al. | |

* cited by examiner

*Primary Examiner*—Richard Chilcot
*Assistant Examiner*—Adriana Figueroa
(74) *Attorney, Agent, or Firm*—Richard C. Litman

(57) ABSTRACT

The truss setting bracket has an elongated body member, a first cradle, and a second cradle. Each cradle is provided with a first and second finger that define a cradle face therebetween. The second cradle is designed to be secured, at ground level, to a truss that is to be set in place on top of a building structure. The first cradle is designed such that, as the truss is lifted into place by a crane, the second finger is used as a guide for spacing the current truss from the previously set truss. Each cradle allows successive trusses to temporarily held in place by the truss setting bracket until all the trusses have been set and they can be permanently nailed or tacked into place.

4 Claims, 9 Drawing Sheets

TRUSS SETTING BRACKET

CROSS REFERENCE TO RELATED APPLICATION

This application is a continuation-in-part of U.S. application Ser. No. 11/209,852 filed Aug. 24, 2005.

BACKGROUND OF THE INVENTION

1. Field of the Invention

The present invention relates to alignment and setting tools, and more specifically to a truss setting bracket adapted for setting and aligning trusses in the construction industry.

2. Description of the Related Art

In the construction of residential homes and other buildings that use wooden trusses as components of the roofing, it is conventional practice to have such trusses constructed at a separate location and then trucked to the building site. Then, after the building foundation, including walls and perimeter beam, has been built, a crane, or other means, is usually employed to lift the trusses, one at a time, from their ground storage location up onto the perimeter beam. Typical trade practice then involves having the crane remain in a support position while a carpenter nails the truss to a horizontal spacer timber in order to stabilize it so the crane can move away to pick up another truss for repetition of the positioning and stabilizing operation.

In such construction operations, cranes are conventionally charged by the hour, so that the greater the number of trusses that can be installed per hour, the lower the labor and equipment costs will be to the contractor. What is needed is a truss setting bracket that will allow a single user to correctly space and set a large number of trusses from a position on the ground. The truss setting bracket should be able to temporarily hold the trusses in place until the user can nail or tack them into permanent position. Therefore, the present invention relates to devices that can effectively reduce the time required for a crane and its operator to set trusses onto a building foundation.

None of the above inventions and patents, taken either singly or in combination, is seen to describe the instant invention as claimed. Thus, a truss setting bracket solving the aforementioned problems is desired.

SUMMARY OF THE INVENTION

The truss setting bracket of the present invention has an elongated body member, a first cradle, and a second cradle. The truss setting bracket is designed to be attached to a truss at ground level before it is raised by a crane to be set in place on top of a building structure. The truss setting bracket allows the user to effectively space and set the each successive truss in place without having to leave the ground until it is time to nail or tack the set trusses permanently in place.

The elongated body member has a first end and a second end and an axis of elongation. The first cradle is attached to the first end of the elongated body member and has a first finger and a second finger defining a horizontal cradle face therebetween. The first and second fingers of the first cradle are positioned substantially normal to the axis of elongation. The second cradle is attached to the second end of the elongated body member and also has a first finger and a second finger defining a horizontal cradle face therebetween. The first and second fingers of the second cradle are also positioned substantially normal to the axis of elongation;

The second cradle is designed to be secured to a truss at ground level that is to be set in place on top of a structure. The first cradle is designed with an elongated second finger such that, as the truss is lifted into place by a crane, the elongated second finger is used as a guide for spacing the current truss from the most recently set truss. Each cradle allows successive trusses to temporarily held in place by the truss setting bracket until all the trusses have been set and they can be permanently nailed or tacked into place.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
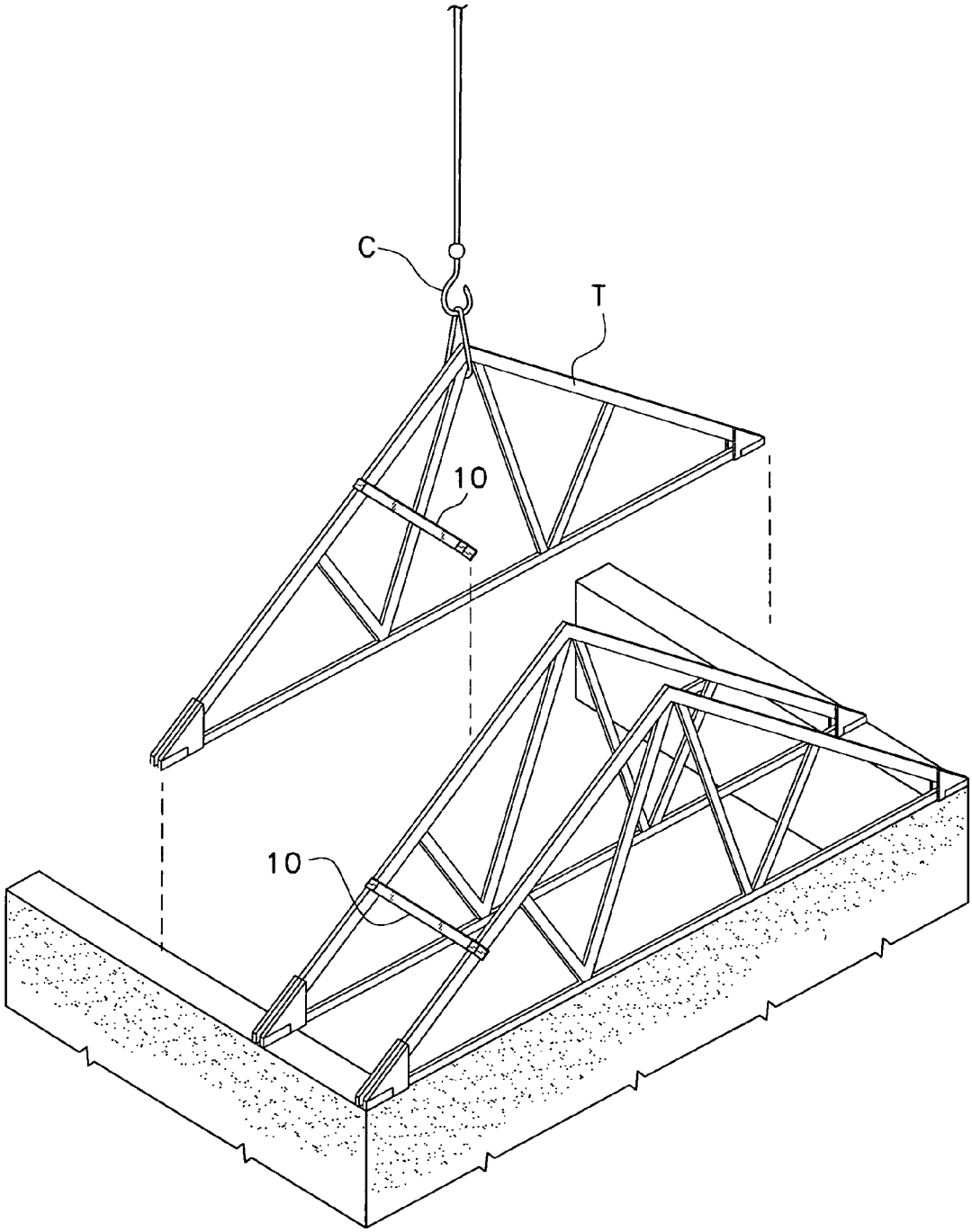
FIG. 1 is an environmental, perspective view of a truss setting bracket according to the present invention.

The present invention is a truss setting bracket, designated generally as 10 in the drawings.

Referring to FIG. 1 of the drawings, truss setting bracket 10 is shown being used to align and set a truss T on a building structure. It is conventional practice to have such trusses constructed at a separate location and then trucked to the building site. Then, after the building foundation, including walls and perimeter beam, has been built, a crane C is usually employed to lift the trusses, one at a time, from their ground storage location up onto the perimeter beam. Truss setting bracket 10 can be created to any length desired, usually an industry standard for required length between trusses, and attached to a truss T that lifted from ground level by crane C and set into place along with the previously installed trusses. After the current truss T has been set into place, truss setting bracket provides the needed support to hold the truss T in place until all of the trusses have been set and can be permanently nailed or tacked into place.

Figure 2:
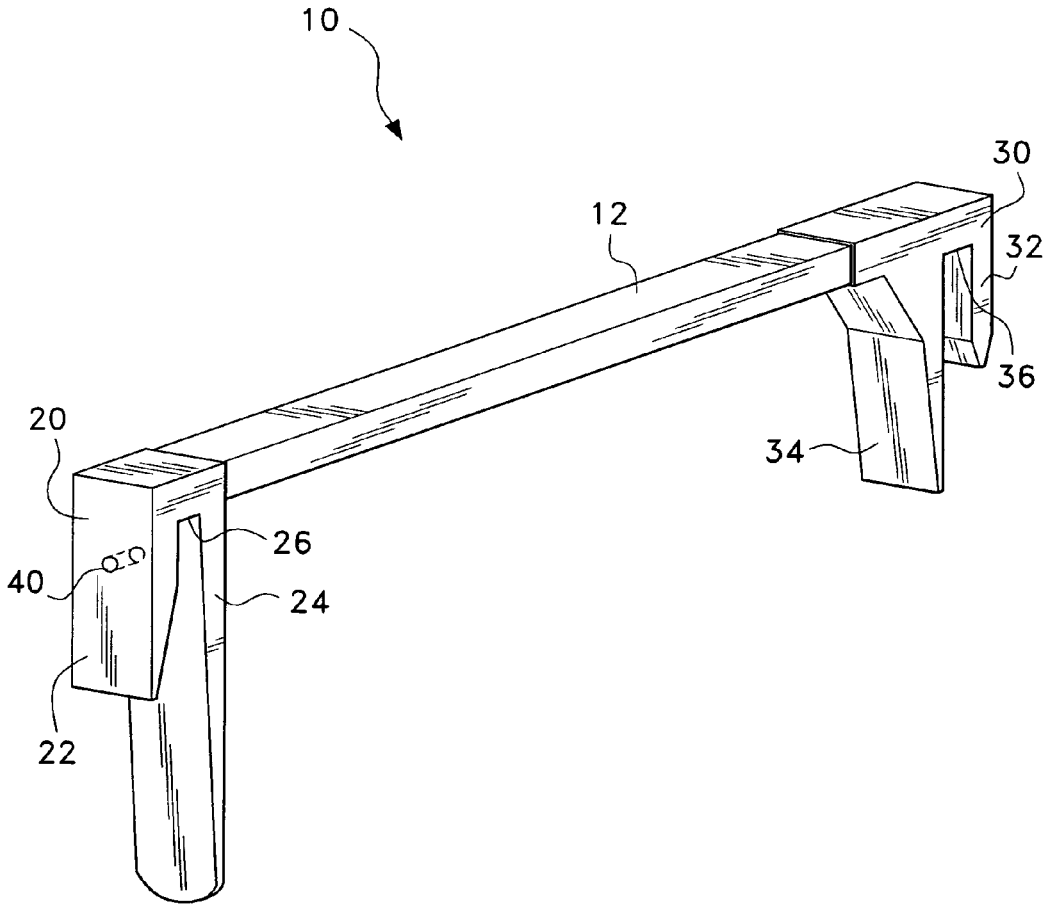
FIG. 2 is a perspective view of a truss setting bracket according to the present invention.
Figure 3:
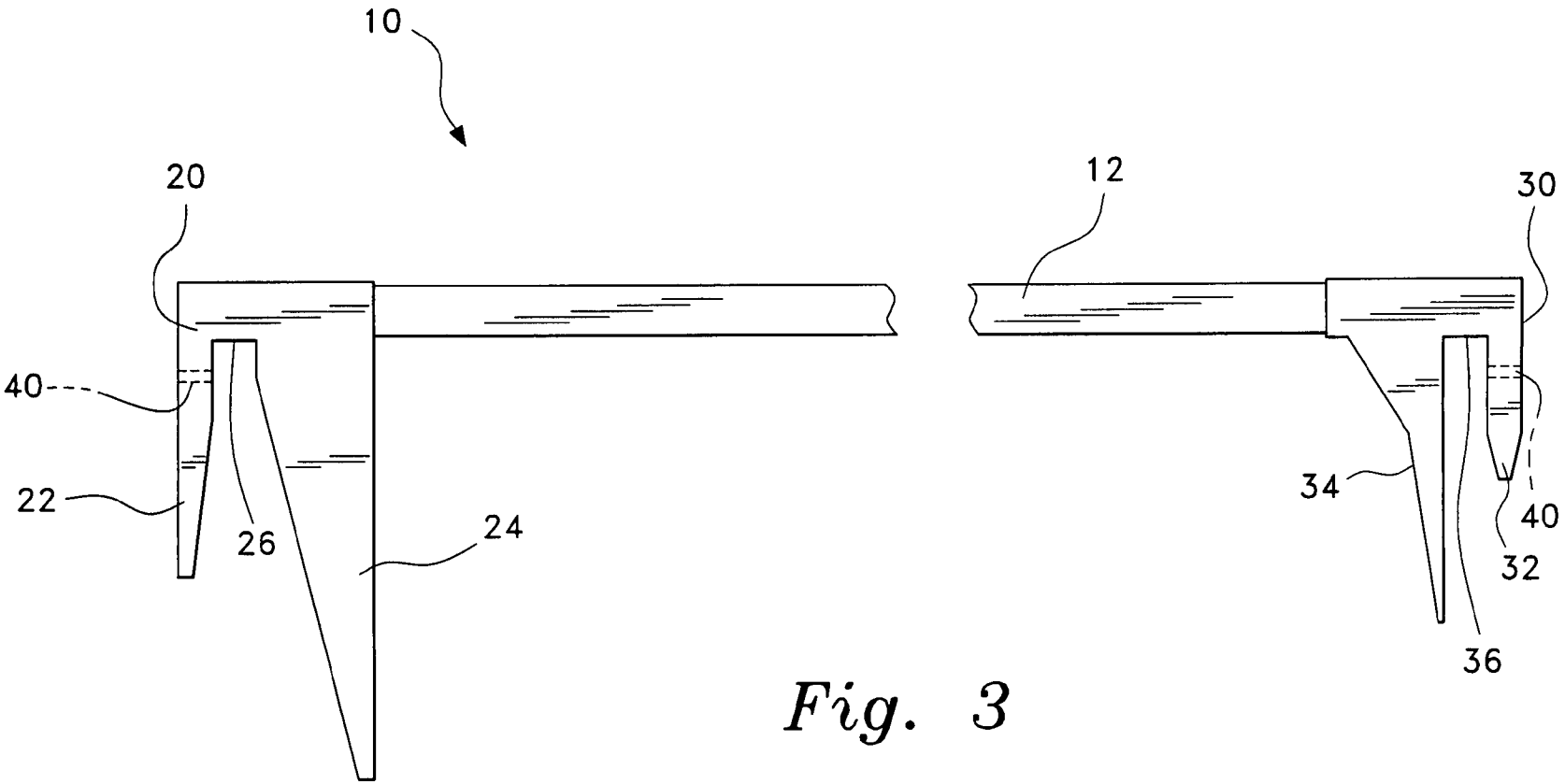
FIG. 3 is a front plan view of a truss setting bracket according to the present invention.

Referring next to FIGS. 2-3, truss setting bracket 10 is shown in a first embodiment. Truss setting bracket 10 has an elongated body member 12 with a first end and a second end that defines an axis of elongation. A first cradle 20 is located at the first end of elongated body member 12 and is defined by a first finger 22 and a second finger 24 with a first horizontal cradle face 26 therebetween, first finger 22 and second finger 24 of first cradle 20 being positioned substantially normal to the axis of elongation of elongated body member 12. A second cradle 30 is located at the second end of elongated body member 12 and is defined by a first finger 32 and a second finger 34 with a second horizontal cradle face 36 therebetween, first finger 32 and second finger 34 of second cradle 30 being positioned substantially normal to the axis of elongation of elongated body member 12. In a preferred embodiment, first finger 22 of first cradle 20 and first finger 32 of second cradle 30 are each provided with an aperture 40 extending through the entire finger. Apertures 40 allow truss setting bracket 10 to be nailed or tacked into place relative to one or more trusses, if needed.

In the preferred embodiment, second finger 24 of first cradle 20 has a sloped surface adjacent to first horizontal cradle face 26 that allows first cradle 20 to easily bump into and slide over an existing truss as the current truss is being set.

In use, truss setting bracket 10 is connected, at ground level, to a truss to be set. The truss setting bracket 10 is secured to the truss with the use of the second cradle 30 by simply hammering the second cradle 30 over the truss to create a tight, friction fit with the truss resting flush along second horizontal cradle face 36. As the truss is lifted into place by the crane, the operator can use truss setting bracket 10 as a guide for the placement of the current truss. Second finger 24 of first cradle 20 can be bumped and slid down onto an existing truss, with first horizontal cradle face 26 resting flush with the existing truss, allowing the current truss to be aligned correctly and set into place. Truss setting bracket 10 can then be left in place until all trusses have been set, upon which time the user may permanently nail or tack the trusses into place and remove all of the truss setting brackets. The truss setting brackets may then be used over and over on other projects.

Figure 4:
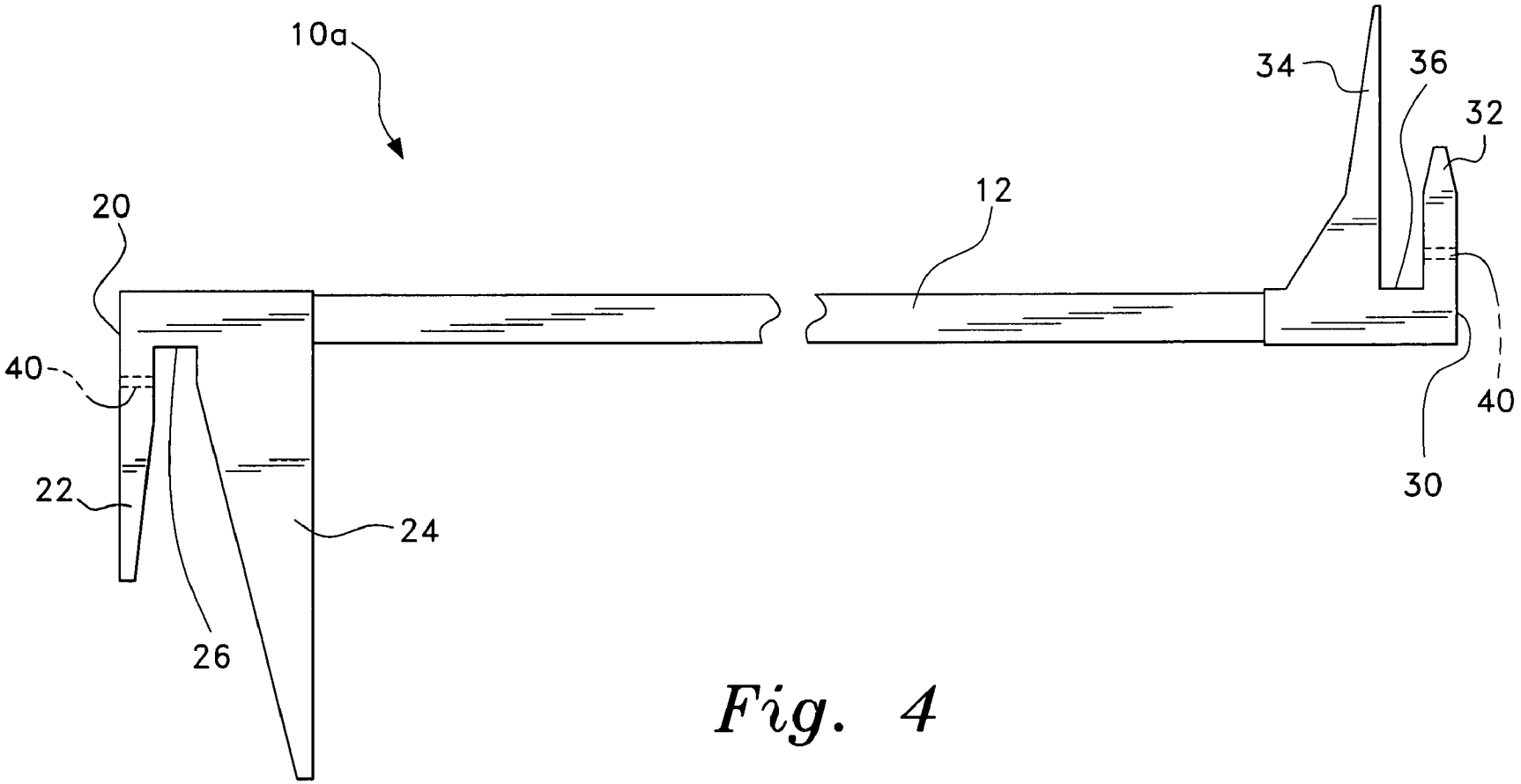
FIG. 4 is front plan view of an alternate embodiment of a truss setting bracket according to the present invention.

FIG. 4 shows an alternate embodiment of truss setting bracket 10*a* having an elongated body member 12, first cradle 20, and second cradle 30. First cradle 20 is located at the first end of elongated body member 12 and is defined by a first finger 22 and a second finger 24 with a first horizontal cradle face 26 therebetween. Second cradle 30 is located at the second end of elongated body member 12 and is defined by a first finger 32 and a second finger 34 with a second horizontal cradle face 36 therebetween. In the alternate embodiment, first cradle 20 and second cradle 30 are provided on opposite sides of elongated body member 12. In this alternate embodiment, first finger 22 and first finger 32 are each provided with apertures 40 therethrough.

Figure 5:
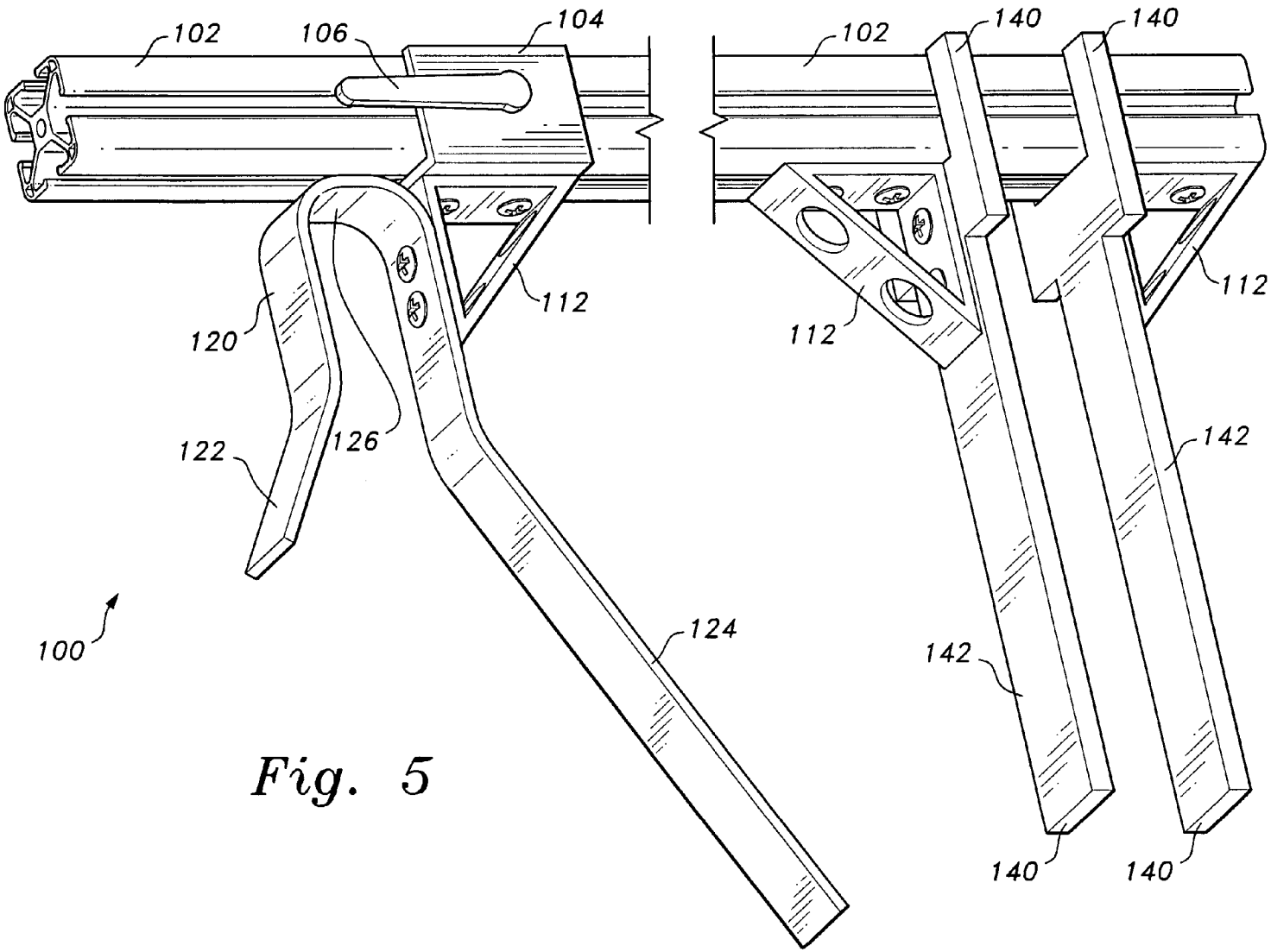
FIG. 5 is a perspective view of another alternate embodiment of a truss setting bracket according to the present invention.
Figure 6:
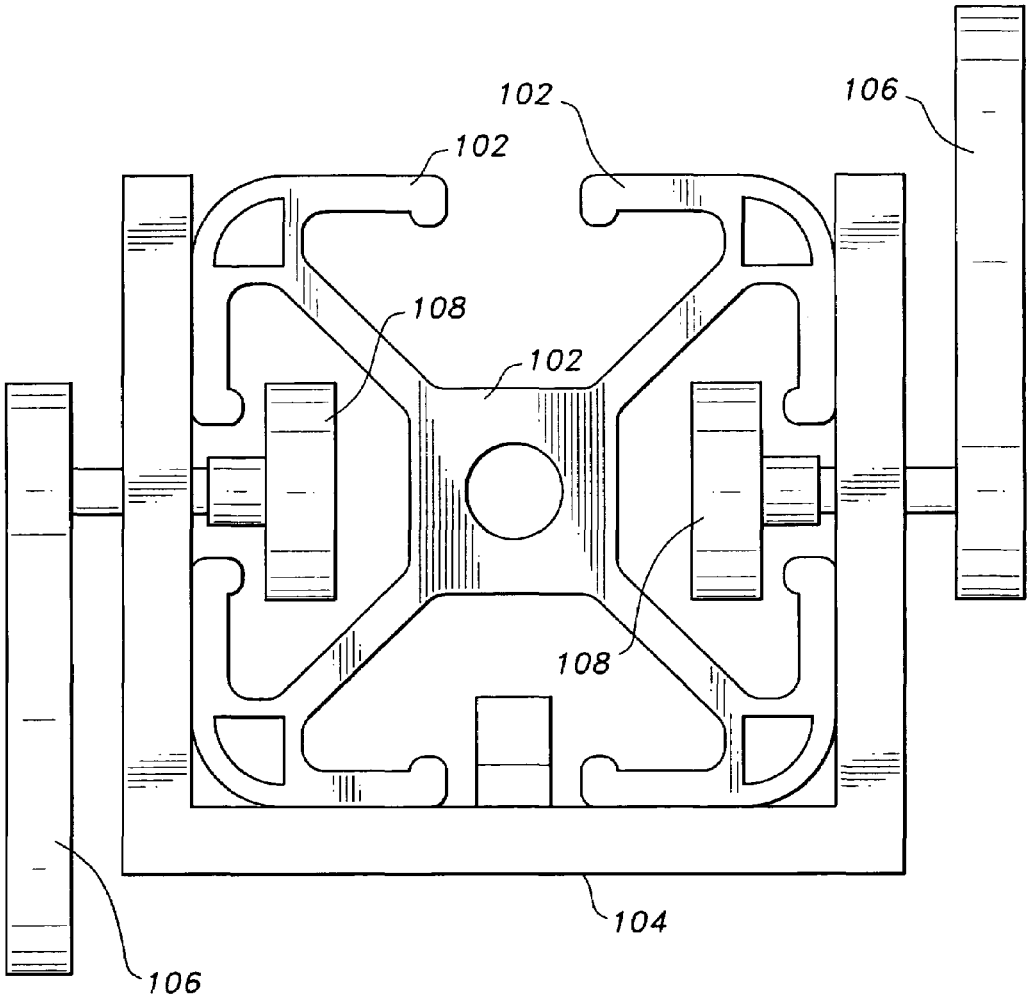
FIG. 6 is a partial end view of the truss setting bracket shown in FIG. 5.

FIGS. 5 and 6 shows an alternate embodiment of truss setting bracket 100 having an elongated body member 102, sliding member 104, first cradle 120, and second cradle 140. Truss setting bracket 100 has an elongated body member 102 with a first end and a second end that defines an axis of elongation. A first cradle 120 is located at the first end of elongated body member 102 and is defined by a first finger 122 and a second finger 124 with a first horizontal cradle face 126 therebetween, first finger 122 and second finger 124 of first cradle 120 being positioned substantially normal to the axis of elongation of elongated body member 102. A second cradle 140 is located at the second end of elongated body member 102 and is defined by a first finger 142 and a second finger 142 with a second horizontal cradle face along elongated body member 102 created therebetween, fingers 142 preferably being identical and being positioned substantially normal to the axis of elongation of elongated body member 102. In a preferred embodiment, fingers 142 are secured to elongated body member 102 with the use of support braces 112.

First cradle 120 is connected to sliding member 104 such that it may be adjusted along elongated body member 102 to accommodate differing distances between successive trusses to be set. Sliding member 104 includes a pair of locking handles 106 and locking mechanisms 108, wherein each of the locking handles 106 operates one of the locking mechanisms 108 such that the sliding member 104 may be selectively locked into place along the axis of elongation at the first end of the elongated body member 102. In a preferred embodiment, a support brace 112 is used to secure first cradle 120 to sliding member 104.

Figure 7:
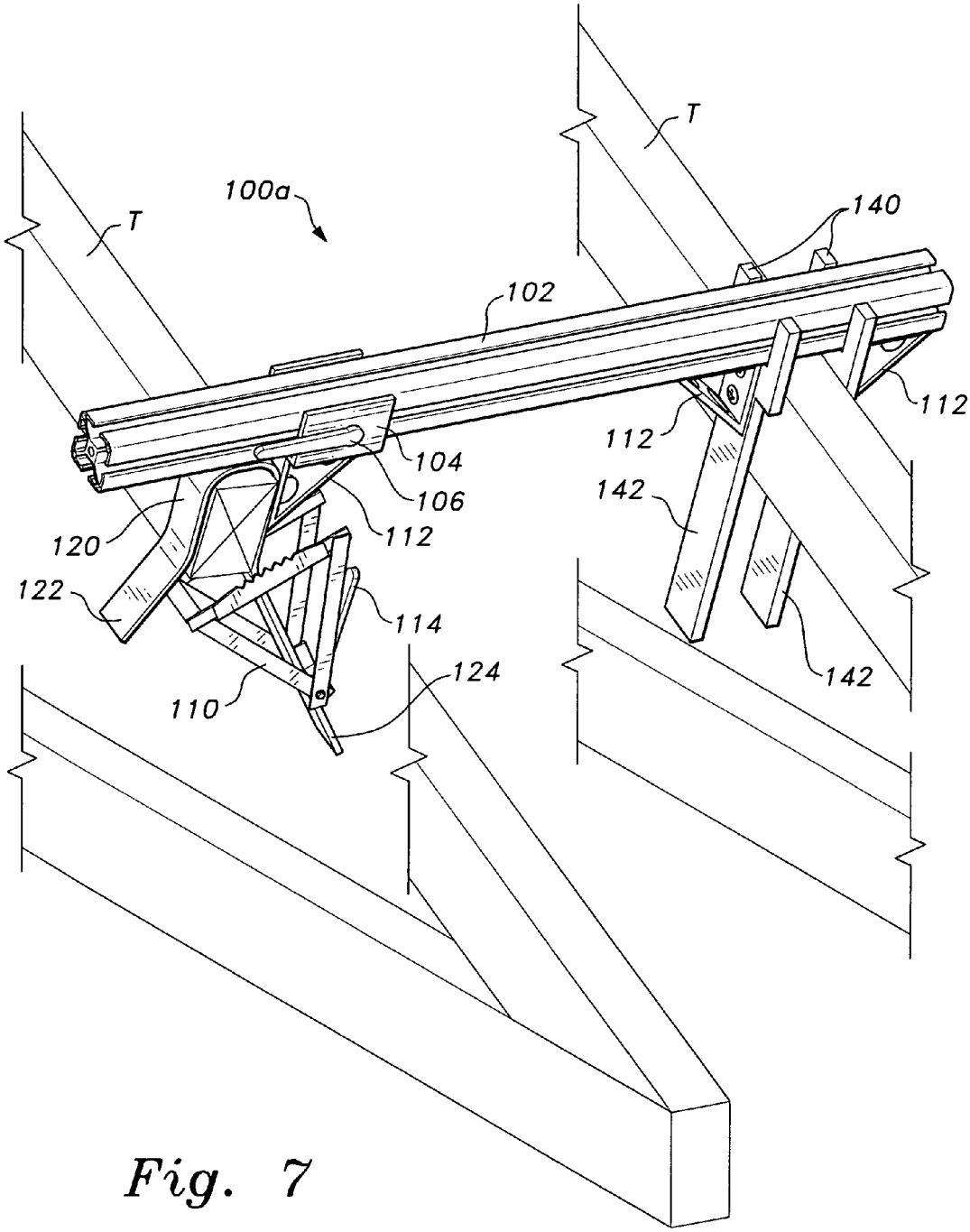
FIG. 7 is an environmental, perspective view of another alternate embodiment of a truss setting bracket according to the present invention.

FIG. 7 shows a further alternate embodiment of truss setting bracket 100*a* having an elongated body member 102, sliding member 104, first cradle 120, second cradle 140, and securing lobe 110. Truss setting bracket 100*a* has an elongated body member 102 with a first end and a second end that defines an axis of elongation. A first cradle 120 is located at the first end of elongated body member 102 and is defined by a first finger 122 and a second finger 124 with a first horizontal cradle face 126 therebetween, first finger 122 and second finger 124 of first cradle 120 being positioned substantially normal to the axis of elongation of elongated body member 102. Securing lobe 110 is provided for further securing a truss T within first cradle 120 and is pivotally secured to second finger 124 and includes handle 114 for rotating securing lobe 110 into a desired position. In a preferred embodiment, securing lobe 110 is provided with teeth for securely gripping a truss T within first cradle 120.

A second cradle 140 is located at the second end of elongated body member 102 and is defined by a first finger 142 and a second finger 142 with a second horizontal cradle face along elongated body member 102 created therebetween, fingers 142 preferably being identical and being positioned substantially normal to the axis of elongation of elongated body member 102. In a preferred embodiment, fingers 142 are secured to elongated body member 102 with the use of support braces 112.

First cradle 120 is connected to sliding member 104 such that it may be adjusted along elongated body member 102 to accommodate differing distances between successive trusses T to be set. Sliding member 104 includes a pair of locking handles 106 such that the sliding member 104 may be selectively locked into place along the axis of elongation at the first end of the elongated body member 102. In a preferred embodiment, a support brace 112 is used to secure first cradle 120 to sliding member 104.

Figure 8:
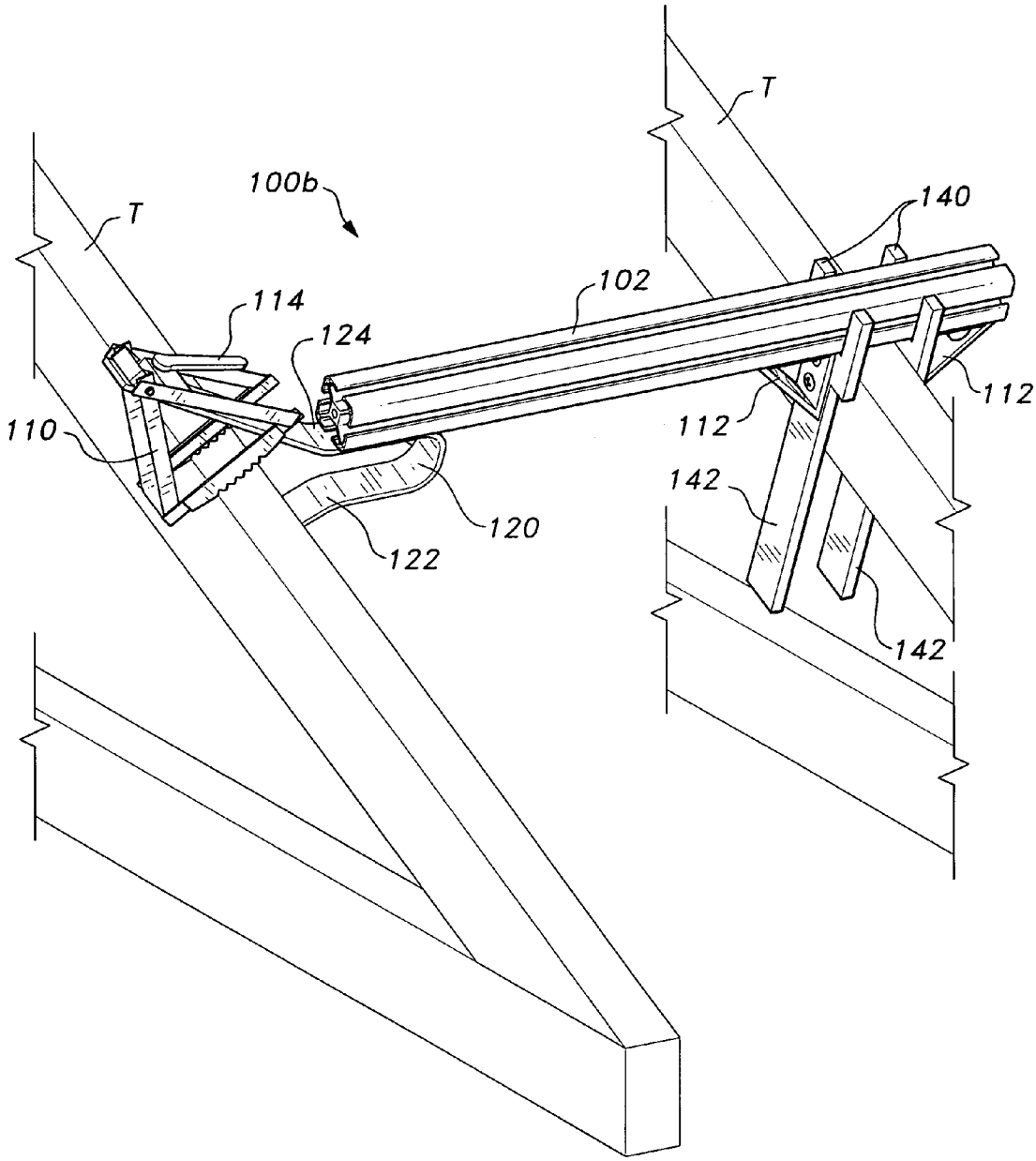
FIG. 8 is an environmental, perspective view of another alternate embodiment of a truss setting bracket according to the present invention.

FIG. 8 shows a further alternate embodiment of truss setting bracket 100*b* having an elongated body member 102, first cradle 120, second cradle 140, and securing lobe 110. Truss setting bracket 100*b* has an elongated body member 102 with a first end and a second end that defines an axis of elongation. A first cradle 120 is located at the first end of elongated body member 102 and is defined by a first finger 122 and a second finger 124 with a cradle face created therebetween, first finger 122 and second finger 124 of first cradle 120 being positioned substantially parallel to the axis of elongation of elongated body member 102. Securing lobe 110 is provided for further securing a truss T within first cradle 120 and is pivotally secured to second finger 124 and includes handle 114 for rotating securing lobe 110 into a desired position. In a preferred embodiment, securing lobe 110 is provided with teeth for securely gripping a truss T within first cradle 120.

A second cradle 140 is located at the second end of elongated body member 102 and is defined by a first finger 142 and a second finger 142 with a second horizontal cradle face along elongated body member 102 created therebetween, fingers 142 preferably being identical and being positioned substantially normal to the axis of elongation of elongated body member 102. In a preferred embodiment, fingers 142 are secured to elongated body member 102 with the use of support braces 112.

Figure 9:
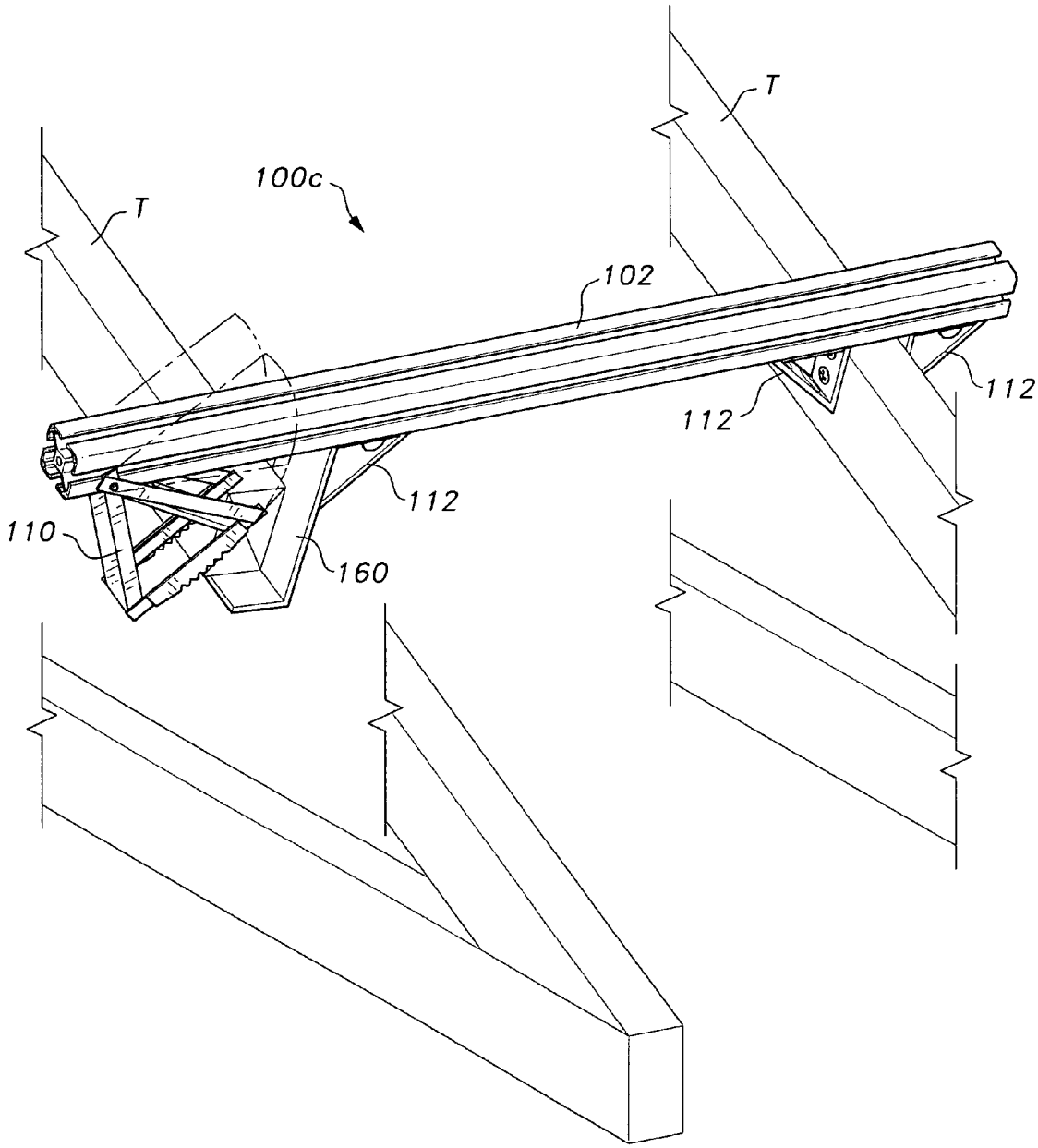
FIG. 9 is an environmental, perspective view of another alternate embodiment of a truss setting bracket according to the present invention.

FIG. 9 shows yet an additional embodiment of truss setting bracket 100*c* having an elongated body member 102, support braces 112, L-bracket 160, and securing lobe 110. Truss setting bracket 100*c* is specifically designed for trusses T that are being tilted up from a resting position on the floor or ground. The already set truss is secured at a first end within L-bracket 160, which is supported along elongated body member 102 by a support brace 112. The already set truss can be further secured with the use of securing lobe 110, which can be rotated into the desired position. The truss being tilted up into place is secured at a second end of truss setting bracket 100*c*, between two additional support braces 112.

It is to be understood that the present invention is not limited to the embodiments described above, but encompasses any and all embodiments within the scope of the following claims.

I claim:

1. A truss setting bracket, comprising:

an elongated body member having a first end and a second end and an axis of elongation;

a sliding member connected along the axis of elongation at the first end of the elongated body member, the sliding member having a pair of locking handles and a pair of locking mechanisms, wherein each of the locking handles operates one of the locking mechanisms such that the sliding member may be selectively locked into place along the axis of elongation at the first end of the elongated body member;

a first cradle, the first cradle being attached to the sliding member at the first end of the elongated body member, the first cradle having a first finger and a second finger defining a first horizontal cradle face therebetween, the first finger and second finger of the first cradle being positioned substantially normal to the axis of elongation;

a second cradle, the second cradle being attached to the second end of the elongated body member, the second cradle having a first finger and a second finger defining a second horizontal cradle face therebetween, the first finger and second finger of the second cradle being positioned substantially normal to the axis of elongation; and a securing lobe, the securing lobe being pivotally connected to the second finger of the first cradle, the securing lobe having a handle for rotating the securing lobe to a desired location.

2. The truss setting bracket according to claim 1, further comprising a first support brace, the first support brace being disposed between the sliding member and the first cradle for attaching the first cradle to the sliding member at the first end of the elongated body member.

3. The truss setting bracket according to claim 2, further comprising a second support brace, the second support brace being disposed between the elongated body member and the first finger of the second cradle for attaching the second cradle to the elongated body member.

4. The truss setting bracket according to claim 3, further comprising a third support brace, the third support brace being disposed between the elongated body member and the second finger of the second cradle for attaching the second cradle to the elongated body member.

* * * * *